US007886933B2

(12) United States Patent
Hirasawa et al.

(10) Patent No.: US 7,886,933 B2
(45) Date of Patent: Feb. 15, 2011

(54) HOUSEHOLD SANITARY TISSUE PAPER CONTAINER

(75) Inventors: Akira Hirasawa, Fujinomiya (JP); Hiroshi Ono, Fujinomiya (JP)

(73) Assignee: Daio Paper Corporation, Ehime (JP)

( * ) Notice: Subject to any disclaimer, the term of this patent is extended or adjusted under 35 U.S.C. 154(b) by 165 days.

(21) Appl. No.: 11/579,792

(22) PCT Filed: May 6, 2005

(86) PCT No.: PCT/JP2005/008358

§ 371 (c)(1),
(2), (4) Date: Nov. 7, 2006

(87) PCT Pub. No.: WO2005/108238

PCT Pub. Date: Nov. 17, 2005

(65) Prior Publication Data

US 2008/0257903 A1 Oct. 23, 2008

(30) Foreign Application Priority Data

May 7, 2004 (JP) ..... 2004-138316

(51) Int. Cl.
*A47K 10/24* (2006.01)

(52) U.S. Cl. ..... 221/302; 221/48; 221/33; 221/304; 221/32; 229/200; 229/237; 229/238; 229/240

(58) Field of Classification Search ..... 221/1–312 C; 229/200, 237, 238, 240
See application file for complete search history.

(56) References Cited

U.S. PATENT DOCUMENTS 2,334,536 A * 11/1943 Broeren et al. ..... 221/48
2,849,152 A * 8/1958 Tuttle ..... 221/48
3,036,729 A * 5/1962 Asman ..... 221/48
3,043,472 A * 7/1962 Nemoede ..... 221/48
3,083,866 A * 4/1963 Strange ..... 221/48
3,207,361 A * 9/1965 Marcalus ..... 221/48
3,207,411 A * 9/1965 Farquhar ..... 229/162.3
3,258,156 A * 6/1966 Smith ..... 221/63
3,325,003 A * 6/1967 Bilezerian ..... 206/494
4,678,099 A * 7/1987 Matsui ..... 221/48
4,785,970 A * 11/1988 Engelmayer ..... 221/47
5,219,421 A * 6/1993 Tipping ..... 221/63
5,542,598 A * 8/1996 Capo ..... 229/242
6,419,144 B2 * 7/2002 Aota et al. ..... 228/112.1
6,758,369 B2 * 7/2004 Morin et al. ..... 221/48
6,905,025 B2 * 6/2005 Morin ..... 206/494

FOREIGN PATENT DOCUMENTS

| | | |
|---|---|---|
| JP | 57-61018 | 12/1982 |
| JP | 63-144492 | 9/1988 |
| JP | S63-144492 | 9/1988 |
| JP | H4-80878 | 7/1992 |
| JP | 2005-225562 | 8/2005 |

* cited by examiner

*Primary Examiner*—Gene Crawford
*Assistant Examiner*—Michael K Collins
(74) *Attorney, Agent, or Firm*—DLA Piper LLP (US)

(57) ABSTRACT

In a household sanitary tissue paper container 1 that has a slender taking-out opening 2 where a film for supporting a household sanitary tissue paper 10 is not provided at the taking-out opening 2, the taking-out opening 2 having finger inserting portions 2B and supporting portions 2A for supporting a pulled-out household sanitary tissue paper 10 is provided, and in outside positions of edges of the supporting portions 2A in a width direction, crush portions for raising 5 along a longitudinal direction are formed respectively so as to continue into the taking-out opening 2.

13 Claims, 6 Drawing Sheets

HOUSEHOLD SANITARY TISSUE PAPER CONTAINER

TECHNICAL FIELD

The present invention relates to a household sanitary tissue paper container of a filmless type which does not have any film for supporting a household sanitary tissue paper at a taking-out opening.

BACKGROUND ART

Conventionally, a household sanitary tissue paper container is constituted such that a perforated line is formed in an approximately rectangular shape on an upper face of the household sanitary tissue container put in a product and a taking-off opening is opened by cutting an unsealing strip surrounded by the perforated line. It is also constituted such that the taking-off opening is closed by a resin film having a slit along a longitudinal direction thereof and a household sanitary tissue paper pulled out of the container is supported between the slit. Incidentally, an arc-shaped cutting-off portion formed at an end portion of the unsealing strip is a fingertip insertion portion for inserting a finger of a user when the unsealing strip is torn.

Since there is a problem such as occurrence of a poisonous gas because of incineration of a container when such a resin film is attached to the container, a household sanitary tissue container of a filmless type with no film has come onto the market recently.

In the conventional container of a filmless type, however, in order to support a pulled-out household sanitary tissue paper at both side portions of the taking-out opening, forming standing plate portions at both end portions in a longitudinal direction to prevent falling-in of the pulled-out household sanitary tissue paper is described in JU-A-63-144492. It has been found that, since four cuts and four perforated lines are formed for this purpose, such a complicated operation is not only needed that the four perforated lines are torn carefully and the standing plate portions at both the side portions in a longitudinal direction is raised, but also a preventive effect on falling-in of the pulled-out household sanitary tissue paper is not achieved yet by the standing plate portions.

DISCLOSURE OF THE INVENTION

1. Problem to be Solved by the Invention

A main object of the invention is to provide a household sanitary tissue paper container of a filmless type in which opening operation is easy, and an effect of preventing falling-in of a pulled-out household sanitary tissue paper is further high.

2. Means for Solving the Problem

The present invention which has solved the above-described problem is as follows:

(Claim 1)

A household sanitary tissue paper container that does not have any film for supporting a household sanitary tissue paper at a taking-out opening, wherein the whole of the taking-off opening is formed at an upper face of the container by removing a continuous unsealing strip along a longitudinal direction in an area formed by a continuous perforated line for tearing, the taking-out opening has finger inserting portions formed at both end portions in a longitudinal direction, and a pair of supporting portions for supporting a pulled-out household sanitary tissue paper which are continuous to the finger inserting portions and are facing both sides of the household sanitary tissue paper, and which are formed by removing the unsealing strip, edges of the supporting portions are spaced, and the edge of each supporting portion forms a shape extending out alike and gently curved toward the center in the longitudinal direction, and at outward positions in a width direction of the edges of the supporting portions, pressed lines for raising along the longitudinal direction so as to be continuous to the taking-out opening are formed respectively, and the respective supporting portions can stand upwardly using the pressed line for raising as a raising line.

(Operation and Effect)

In such an embodiment, an taking-out opening can be formed by pushing fingertips in the finger inserting portions formed at both the end portions in the longitudinal direction so as to insert the fingertips therein, tearing an end portion of the perforated line for tearing, and separating the unsealing strip continuously to remove the same from the upper face of the container while pinching the end portion of the unsealing strip. Thereafter, by raising the respective supporting portions obliquely upwardly using the pressed line for raising as a raising line, a shape of the taking-out opening can be retained finally.

The edges of the supporting portions are spaced, and the edge of each supporting portion forms a shape extending out alike and gently curved toward the center in the longitudinal direction. Therefore, the finger inserting portions formed at both the end portions in the longitudinal direction are wide, even if there is no function of sandwiching both sides of the pulled-out household sanitary tissue paper, in a state the respective supporting portions are raised obliquely upwardly using the pressed line for raising as a raising line, both the sides of the pulled-out household sanitary tissue paper can be retained in a narrow space between the edges of the supporting portions at central portions in a sandwiching manner, so that the effect of preventing falling-in of the pulled-out household sanitary tissue paper is significant.

Besides, since the respective supporting portions are raised obliquely upwardly to be projected from the upper face of the container, the distal end portion of a household sanitary tissue paper pulled out subsequently is put in a state as if to lean on the edge of the supporting portion at the central portion, so that the effect of preventing falling-in of the pulled-out household sanitary tissue paper into the container is significant. In further explanation regarding this point, when the supporting portions are not raised, the household sanitary tissue paper pulled out subsequently often gets into the container due to its own weight through an spaced portion between the edges of the supporting portions at the central portions, while, when the respective supporting portions are raised obliquely upwardly to be projected from the upper face of the container, the distal end portion of a household sanitary tissue paper pulled out subsequently tends to bend to one side in process of falling due to its own weight in many case (particularly, since tissue papers are stacked in a staggered state for popping-up, the distal end portion tends to droop toward the direction of a distal end of a folded-back portion of the household sanitary tissue paper pulled out subsequently), the distal end portion of the bent tissue paper is put in a state as if to lean on either edge of the supporting portions at the central portions so as in a covering manner, so that getting into the container is prevented.

Here, assuming a case that the edge of each supporting portion is formed linearly and it is raised obliquely upwardly, even if the distal end portion of a tissue paper which is pulled out and bent leans on either edge of the supporting portions in a covering manner, a component force in a falling direction of the tissue paper acts on the whole edge of the supporting portion approximately equally, so that the tissue paper gets into the container as it is without being caught, while, in the present invention, since each edge of the supporting portions has a shape extending out alike and gently curved toward the center in the longitudinal direction, a catching force of the tissue paper mainly on the central portion of the edge of the supporting portion in the longitudinal direction (frictional force) increases, so that the tissue paper is prevented from getting into the container as it is.

From the above-described explanation, a technical significance will be apparent that a pulled-out tissue paper can be prevented from getting into the container only by a correlation of a point that each edge of the supporting portions in the present invention forms a shape extending out alike and gently curved toward the center in the longitudinal direction and a point that the respective supporting portions can stand up using the pressed line for raising as a raising line.

(Claim 2)

The household sanitary tissue paper container according to claim 1, wherein at least a portion of the perforated line for tearing corresponding to the edge of the supporting portion is a double perforated line.

(Operation and Effect)

When the double perforated line is employed as described in claim 2, the edge of the taking-out opening is cut smoothly without forming undulation, so that, even if a fingertip is rubbed against the edge of the taking-out opening, it becomes hard to have a pain in the finger or hurt the same. Additionally, in the filmless-type container, since a tissue paper is rubbed against the edge of the taking-out opening directly when taken out, there is such a possibility as occurrence of paper powder or tearing of the tissue paper, but the edge of the taking-out opening becomes smooth, so that such a problem is hard to occur.

(Claim 3)

The household sanitary tissue paper container according to claim 2, wherein the perforated line for tearing is a double perforated line comprising an inner perforated line and an outer perforated line comprising cut portions and tie portions, a section line formed when the perforated line for tearing has been torn is configured so as to alternate between the cut portions of the inner perforated line and the outer perforated line, a distance between the outer perforated line and the inner perforated line is 1 mm or less, a length ratio of the cut portion to the tie portion in the inner perforated line is 1.0 to 10.0, and a length ratio of the cut portion to the tie portion in the outer perforated line is 1.0 to 0.1.

(Claim 4)

The household sanitary tissue paper container according to claim 1, wherein the finger inserting portion is formed to have a portion which is 15 mm or more in length and 20 mm or more in width.

(Operation and Effect)

It is a length required for insertion of a finger.

(Claim 5)

The household sanitary tissue paper container according to claim 1, wherein a length ratio of the taking-out opening to the long side of the container is 65 to 87%.

(Operation and Effect)

In a general household sanitary tissue paper container formed in a rectangular-parallelepiped shape, it is preferable that the width of the taking-out opening falls within the range described in claim 5.

(Claim 6)

The household sanitary tissue paper container according to claim 1, wherein the maximum width ratio of the taking-out opening to the short side of the container is 16 to 50%, and the maximum width of the taking-out opening is 38 mm.

(Operation and Effect)

It is preferable that the size ratio of the width of the taking-out opening to the width of the supporting portion falls within the range described in claim 6.

(Claim 7)

The household sanitary tissue paper container according to claim 1, wherein the ratio of the narrowest width space between the edges of the supporting portions to the maximum width of the taking-out opening is 16 to 40%, and the narrowest width of the space between the edges of the supporting portions is 6.08 mm or more.

(Operation and Effect)

When the narrowest width of the space between the edges of the supporting portions is less than 6.08 mm, there is a possibility that the unsealing strip is torn when removed. When the ratio is less than 16%, namely, a swollen curved line of the edge of the supporting portion is sharp, smoothness required when a tissue paper is pulled out is impaired. When the ratio is more than 40%, namely, a swollen curved line of the edge of the supporting portion is gentle, a catching force of the tissue paper mainly on the central portion of the edge of the supporting portion in the longitudinal direction (frictional force) is not sufficient, so that there is a possibility that the tissue paper gets into the container as it is.

(Claim 8)

A household sanitary tissue paper container that does not have any film for supporting a household sanitary tissue paper at a taking-out opening, wherein the whole of the taking-off opening is formed at the upper face of the container by removing a continuous unsealing strip along a longitudinal direction in an area formed by a continuous perforated line for tearing, the taking-out opening has finger inserting portions formed at both end portions in a longitudinal direction, and a pair of supporting portions for supporting a pulled-out household sanitary tissue paper which are continuous to these finger inserting portions and are facing both sides of the household sanitary tissue paper, and which are formed by removing the unsealing strip, edges of the supporting portions are spaced, and the edge of each supporting portion forms a wavy line having undulation in a width direction, and at outward positions in a width direction of the edges of the supporting portions, pressed lines for raising along the longitudinal direction are formed respectively at a cove portion of the wavy line and between the cove portion of the wavy line and the finger inserting portion, and the respective supporting portions can stand upwardly using the pressed line for raising as a raising line.

(Operation and Effect)

Operation and effect similar to those in the case described in claim 1 are obtained. However, since a catching force of the tissue paper on the edge of the supporting portion (frictional force) tends to be averaged, it is hard to say that the effect of preventing falling-in of a pulled-out household sanitary tissue paper is high.

ADVANTAGE OF THE INVENTION

As described above, according to the present invention, summarizing the operations and effects described above, a household sanitary tissue paper container of a filmless type in which opening operation is easy, and an effect of preventing falling-in of a pulled-out household sanitary tissue paper is further high can be provided.

BEST MODE FOR CARRYING OUT THE INVENTION

An embodiment of the present invention will be described below in detail with reference to the accompanying drawings.

Figure 1:
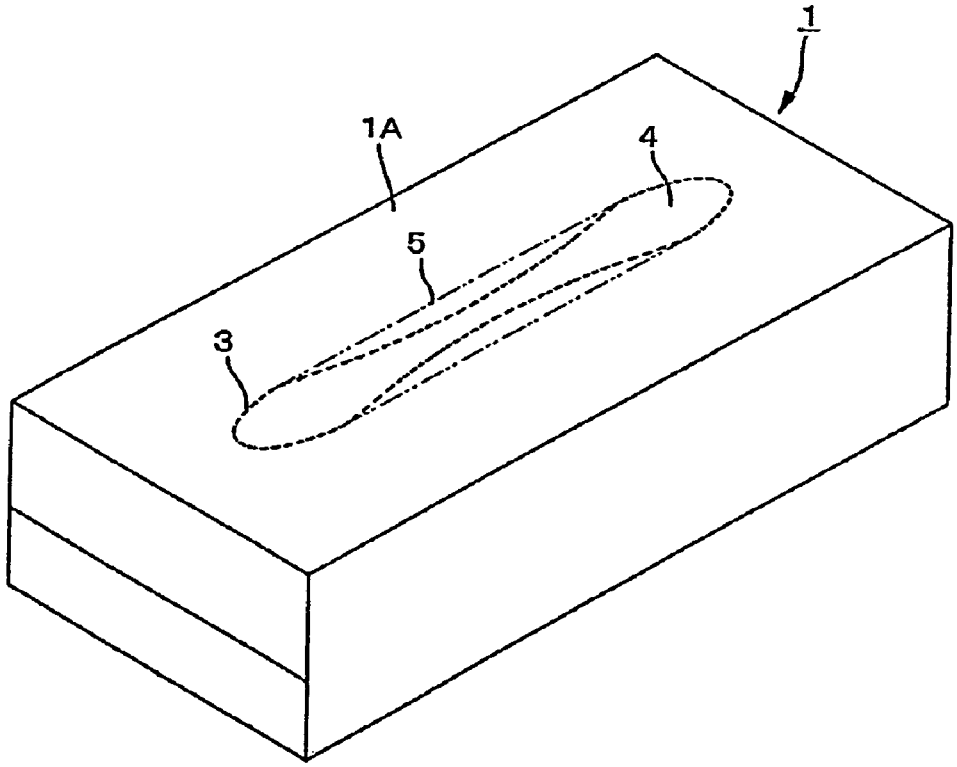
FIG. 1 is a perspective view of a household sanitary tissue paper container.
Figure 2:
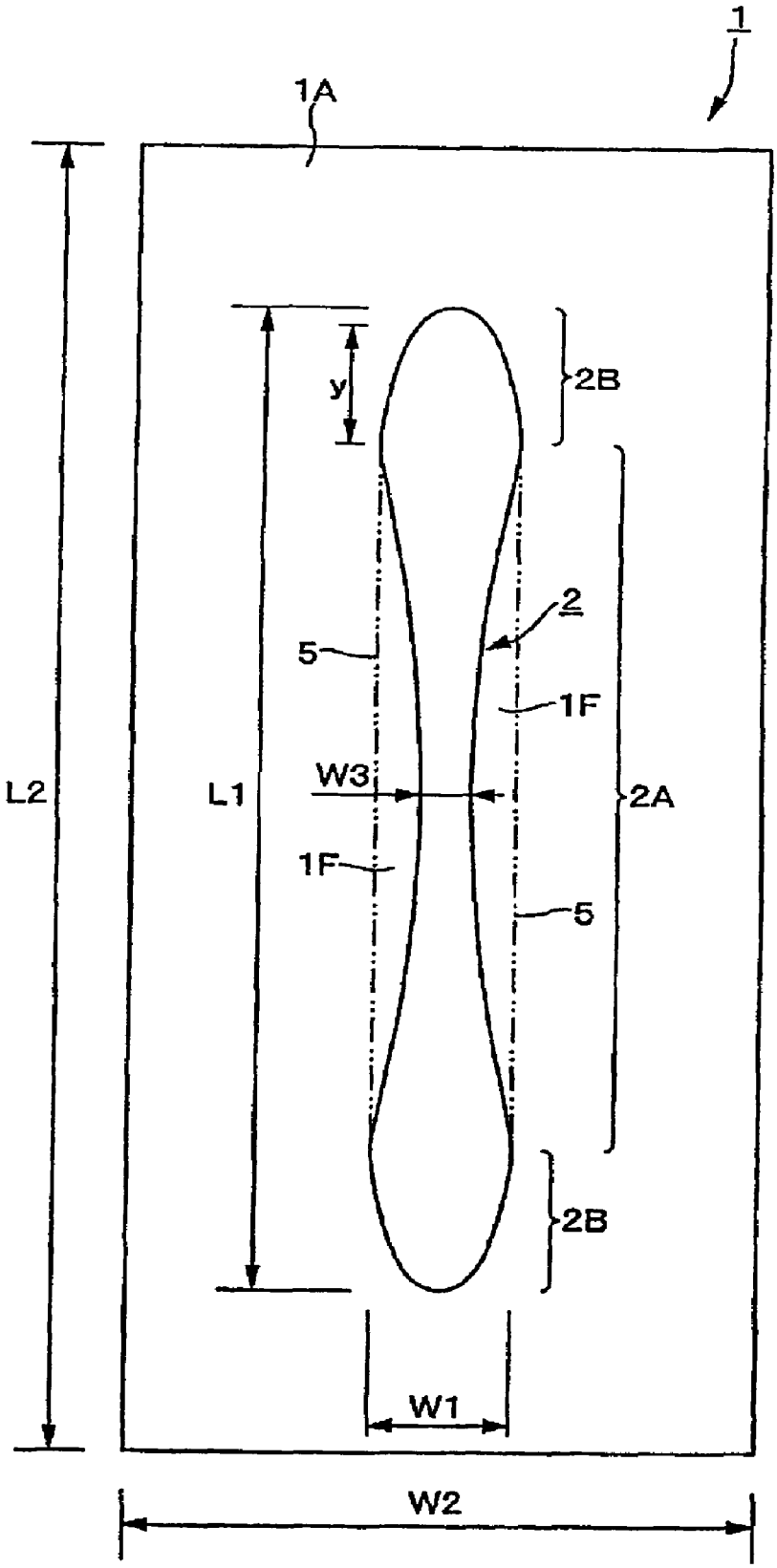
FIG. 2 is a plan view of the household sanitary tissue paper container.

FIG. 1 is a perspective view of a household sanitary tissue paper container (before unsealed) according to the present invention, and FIG. 2 is an enlarged plan view of a taking-out opening portion after unsealed. The household sanitary tissue paper container 1 is formed in an approximately rectangular-parallelepiped shape, and a perforated line for tearing 3 is formed on a upper face 1A of the container 1 along the shape of the taking-out opening 2 in order to form a taking-out opening 2 for a household sanitary tissue paper. A region surrounded by forming the perforated line for tearing 3 constitutes an unsealing strip 4, and the unsealing strip 4 is removed at a usage start time by tearing the perforated line for tearing 3, so that the taking-out opening 2 for taking out household sanitary tissue papers contained inside is formed.

The present invention relates to a filmless type, where any film is not attached about on the taking-out opening 2. The shape of the taking-out opening 2 has supporting portions 2A for a household sanitary tissue paper at the center in a longitudinal direction, and it has finger inserting portions 2B, at both end portions in the longitudinal direction, each of which is formed to be wider than the center portion and has a portion whose length y is 15 mm or more and whose width W1 is 20 mm or more.

The finger inserting portion 2B is preferably formed so as to have a portion whose length y is 10 mm or more and whose width W1 is 15 mm or more, and it is especially more preferable that the finger inserting portion 2B has a size where the length y is 15 to 50 mm and the width W1 is 20 to 45 mm.

The taking-out opening 2 is formed so as to gradually increase in width with a gently curved line from the center in the longitudinal direction toward both the end portions to reach the maximum width near both the ends, and gradually decrease in width with a sharp curved line according to further approaching to both the ends. Edges of both the ends each form an arc-shaped curve.

By adopting such a shape, supporting portions 2A for a household sanitary tissue paper are formed at the center in the longitudinal direction, and the finger inserting portions 2B are formed at both the end portions in the longitudinal direction. Each edge of the supporting portions 2A, 2A forms a shape extending out alike and gently curved toward the center in the longitudinal direction.

By forming the finger inserting portions 2B in an arc-shaped curve, a finger can be inserted in the finger insertion portion naturally, pulling out the first sheet of paper easily or the like is can be made possible, and a finger is never hurt.

Figure 3:
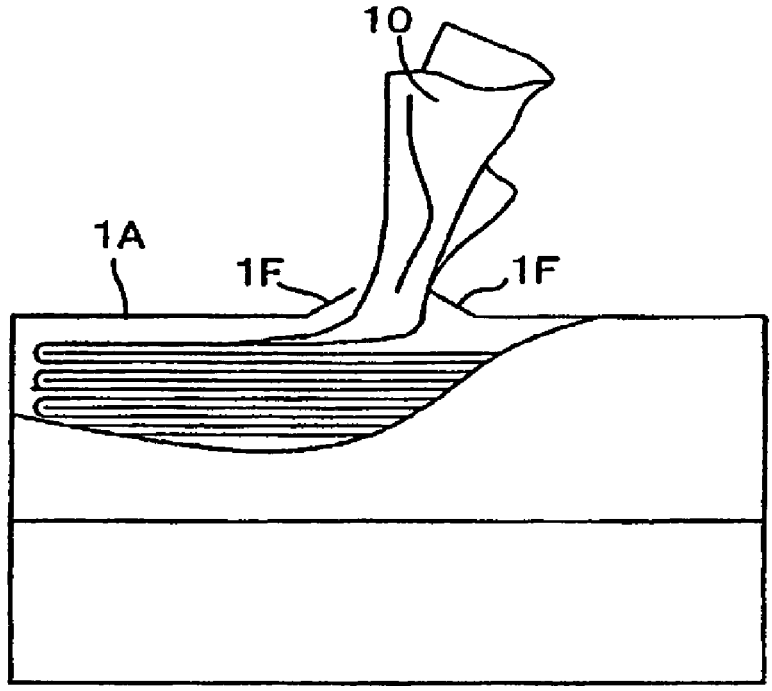
FIG. 3 is a side view of the household sanitary tissue paper container.

A crush portion 5 is provided along a line connecting both the finger inserting portions 2B on both sides of the taking-out opening 2 in a width direction, and the supporting portions 2A for supporting a household sanitary tissue paper pulled out from the taking-out opening 2 by flap portions positioned on the central side of the crush portion 5 in the width direction is constituted. In this case, as shown in FIG. 3, the flap portions 1F on the central side in the width direction are folded outwardly from the inside of the container using the crush portion 5 as a raising line to raise the same obliquely, so that a household sanitary tissue paper 10 can be supported between the standing portions 1F. At this time, by adjusting a degree of raising, a pulling-out resistance or a supporting force on the household sanitary tissue paper 10 can be adjusted in accordance with user's own taste.

The crush portions 5 can be provided not only in a continuous line as illustrated, but also in a dashed line, for example, a dotted line. Additionally, the illustrated crush portion 5 is provided linearly, but it can be provided in various curved lines such as an arc shape.

The size of the taking-out opening 2 can be set according to the size or the shape of the container 1 or the like, but in case of a general household sanitary tissue paper container, it is preferable that setting is performed in the following manner. That is, it is preferable that the ratio of the length L1 of the taking-out opening 2 to the length L2 of a long side of the container is set to 65 to 87%, specifically, 69 to 79%. The taking-out opening 2 becomes too narrow in a range of less than 65%, where a tissue paper becomes easy to be torn when pulled out, while the taking-out opening 2 becomes too wide in a range of more than 87%, where a tissue paper becomes hard to be supported, so that it becomes easy to get into the container.

The maximum width W1 of the taking-out opening is at least 20 mm or more, preferably, 38 mm or more. In a range of less than 20 mm, a function as the finger inserting portion 2B can not be obtained. Further, in a range satisfying the width, it is preferable that the ratio of the width W1 of the taking-out opening to the length W2 of a short side of the container 1 is set to 16 to 50%, specifically, 17 to 35%. The taking-out opening becomes too narrow in a range of less than 16%, where a tissue paper becomes easy to be torn when pulled out, while the taking-out opening becomes too wide in a range of more than 50%, where a tissue paper becomes hard to be supported, so that it becomes easy to get into the container.

It is preferable that the ratio of the narrowest width W3 of the supporting portion 2A in the taking-out opening 2 to the maximum width W1 of the taking-out opening 2 is 16 to 40%, specifically, 17 to 35%. When the narrowest width W3 of the supporting portion 2A is all too narrow with respect to the maximum width W1 of the taking-out opening 2, the shape of the taking-out opening 2 has a sharp curved line, so that it becomes hard to pull out a household sanitary tissue paper smoothly. Therefore, the narrowest width W3 is 3.2 mm (20 mm×0.16) or more, preferably, 6.08 mm (38 mm×0.16) or more.

Figure 4:
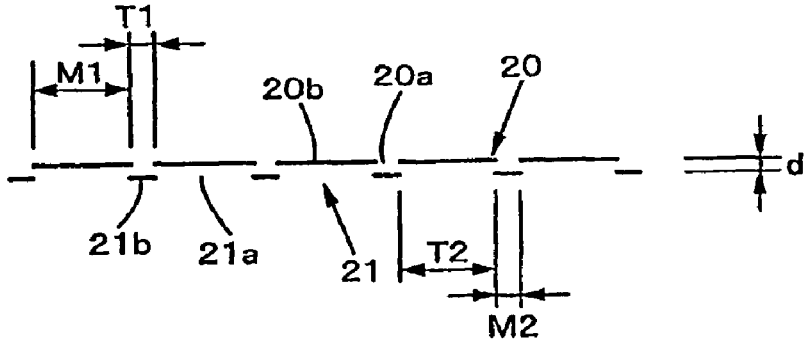
FIG. 4 is an enlarged plan view of a portion of a double perforated line.
Figure 5:
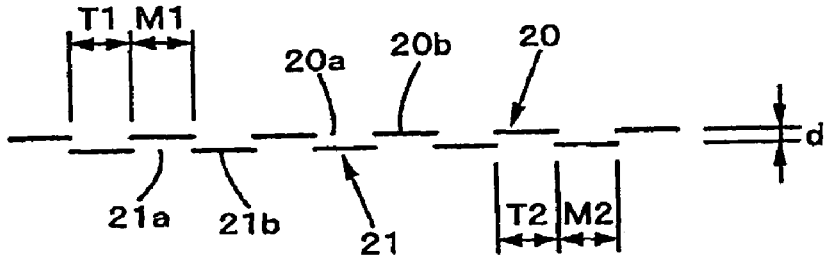
FIG. 5 is an enlarged plan view of a portion of a double perforated line.

On the other hand, a perforated line for tearing 3 may be a general single perforated line, but it is preferably formed all around the taking-out opening 2 as a double perforated line that is composed of an inner perforated line 20 and an outer perforated line 21 each of which is composed of cut portions and tie portions, and where a section line formed when the perforated line for tearing has been torn is arranged so as to alternate between the cut portions of the inner perforated line 20 and the outer perforated line 21, specifically, cut portions 20*b*, 21*b* of the respective inner and outer perforated lines are arranged in a staggered manner. Specific examples of the double perforated line are shown in FIG. 4 and FIG. 5. Though not illustrated, the cut portion 21*b* of the outer perforated line 21 and the cut portion 20*b* of the inner perforated line 20 can be made to have some overlapping margin.

In case that such a double perforated line is employed, a space d between the inner perforated line 20 and the outer perforated line 21 is excessively large, which results in that an unsealing strip 4 is cut merely along the inner perforated line 20 when it is removed by cutting. Therefore, the space d should be set to d=0.5 to 1 mm, preferably, about 0.6 to 0.8 mm such that the sealing strip 4 is cut and removed reliably and finely while the section line alternates between the cut portions 20*b*, 21*b* of the inner perforated line 20 and the outer perforated line 21.

It is preferable that the ratio M1/T1 of length M1 of the cut portion 20*b* to the length T1 of a tie portion 20*a* in the inner perforated line 20 is set to 1.0 to 10.0, especially, 1.0 to 5.0, and the ratio M2/T2 of length M2 of the cut portion 21*b* to the length T2 of a tie portion 21*a* in the outer perforated line 21 is set to 1.0 to 0.1, especially, 1.0 to 0.2.

Specifically, as shown in FIG. 4, it is preferable that the inner perforated line 20 where the length of the cut portion 20 *b* is long is formed, the outer perforated line 21 where the length of the cut portion 21*b* is shorter than that of the inner perforated line is formed (namely, formed so as to satisfy M1>M2), and the cut portion 21*b* of the outer perforated line 21 is formed so as to be positioned outside the tie portion 20*a* of the inner perforated line 20. In this case, it is preferable that the length M1 of the cut portion 20*b* in the inner perforated line 20 is designed within the range of more than the length M2 of the cut portion 21*b* in the outer perforated line 21 to 10 times the length M2 or less. Specifically, it is preferable that the length M1 of the cut portion 20*b* in the inner perforated line 20 is set to 1.0 to 5.0 mm, and it is preferable that the length T1 of the tie portion 20*a* is set to 0.5 to 1.0 mm. Additionally, it is preferable that the length T2 of the cut portion 21*b* in the outer perforated line is set to 0.5 to 1.0 mm, and it is preferable that the length T2 of the tie portion 21*a* is set to 1.0 to 5.0 mm.

Since a tearing function depending on the cut portion 20*b* of the inner perforated line 20 is dominant, and the outer perforated line is configured secondarily in this manner, such a projection as formed in case of the single perforated line is never formed at the edge of the taking-out opening 2 after tearing, so that a fingertip is hard to be hurt even if rubbed against the edge. Therefore, the finger inserting portion can also be designed to be as small as possible. Further, in this case, tearing can be performed easily by a little force.

Of course, as shown in FIG. 5, the inner perforated line 20 and the outer perforated line 21 can be evenly formed so as to arrange the cut portions 20*b*, 21*b* of the respective inner and outer perforated lines in a staggered manner while the lengths M1, M2 of the cut portions 20*b*, 21*b* are made to be equal and the lengths T1, T2 of the tie portions 20*a*, 21*a* are made to be equal in the inner perforated line 20 and the outer perforated line 21. This case is also much more preferable than the single perforated line.

The taking-out portion 2 is sectioned into the finger inserting portion 2B and the supporting portion 2A, formation of a double perforated line can be changed in the respective regions. For example, it is possible to employ the perforated line shown in FIG. 4 in the finger inserting portion 2B emphasizing injury-preventing property and unsealing easiness, and the perforated line shown in FIG. 5 in the supporting portion 2A.

Figure 6:
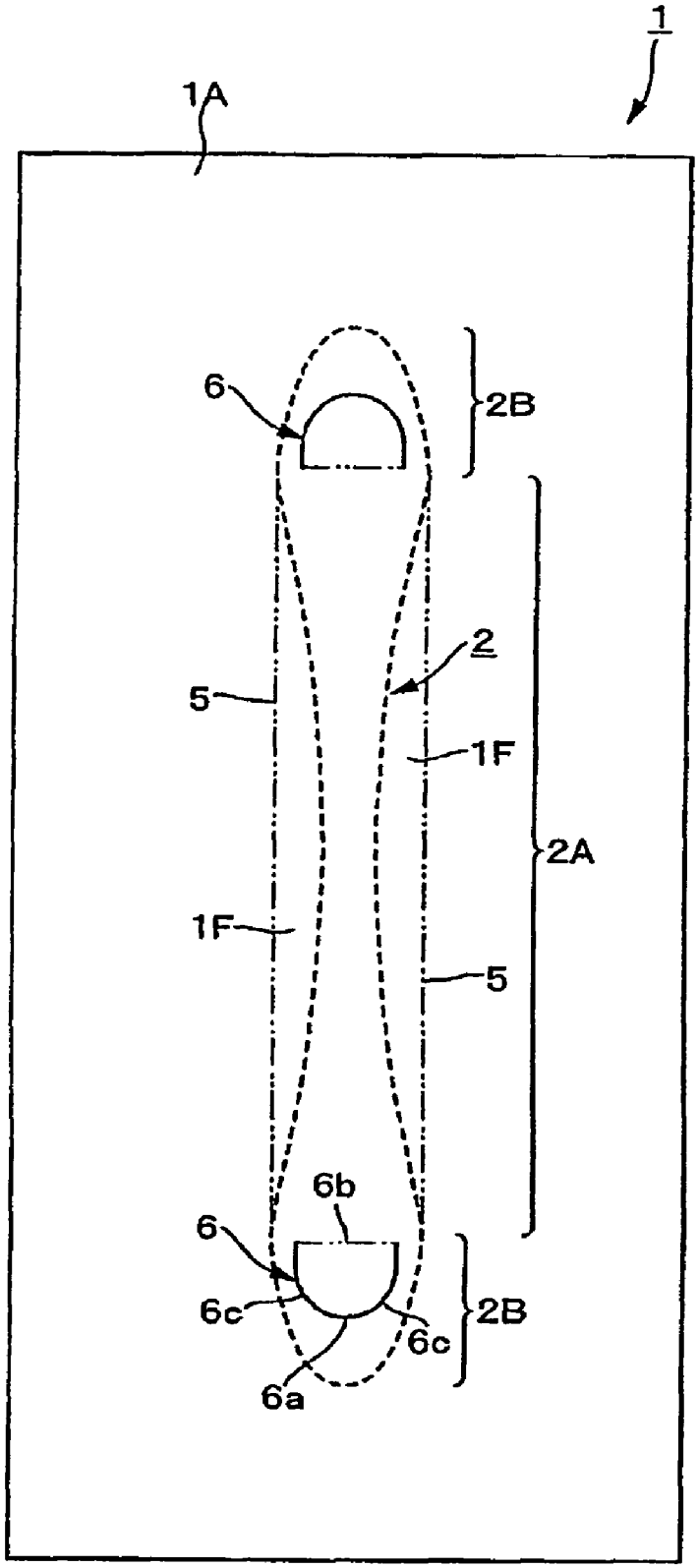
FIG. 6 is a plan view of the household sanitary tissue paper container.

On the other hand, in a household sanitary tissue paper container, as shown in FIG. 6, there is an aspect where fingertip inserting portions 6 required when the unsealing strip 4 is cut and removed are formed at both the end portions of the unsealing strip 4 in the longitudinal direction, and the aspect can be employed in the present invention. The fingertip inserting portion 6 in the illustrated example is constituted to have a half-arc-shaped perforated line including a pair of 90-degree arc-shaped cut lines 6*c*, 6*c* for forming fingertip holes and a tie portion 6*a* at the center between the 90-degree arc-shaped cut lines 6*c*, 6*c*, and a crush portion 6*b* formed along a radius line portion of the half-arc-shaped perforated line. When the unsealing strip 4 is cut and removed, after pushing fingertips into the fingertip inserting portions 6, the unsealing strip 4 is pulled up while catching the fingertip inserting portions 3 by the fingers and torn along a perforated line 3 to remove the same. At this time, the fingertip inserting portion 6 is folded with respect to the unsealing strip 4 main body due to the crush portion 6*b*. Even in such a case, such an effect of the present invention as easiness of finger insertion or hardness in finger injury at such a time that a first sheet of household sanitary tissue paper is pulled out from the taking-out opening 2 is achieved without any difference.

(Other)

The shape of the taking-out opening of the present invention is not limited to the above-described example, as long as the taking-out opening has the finger inserting portion whose length is 15 mm or more and whose width is 20 mm or more, and the supporting portion for supporting a pulled-out household sanitary tissue paper.

Figure 7:
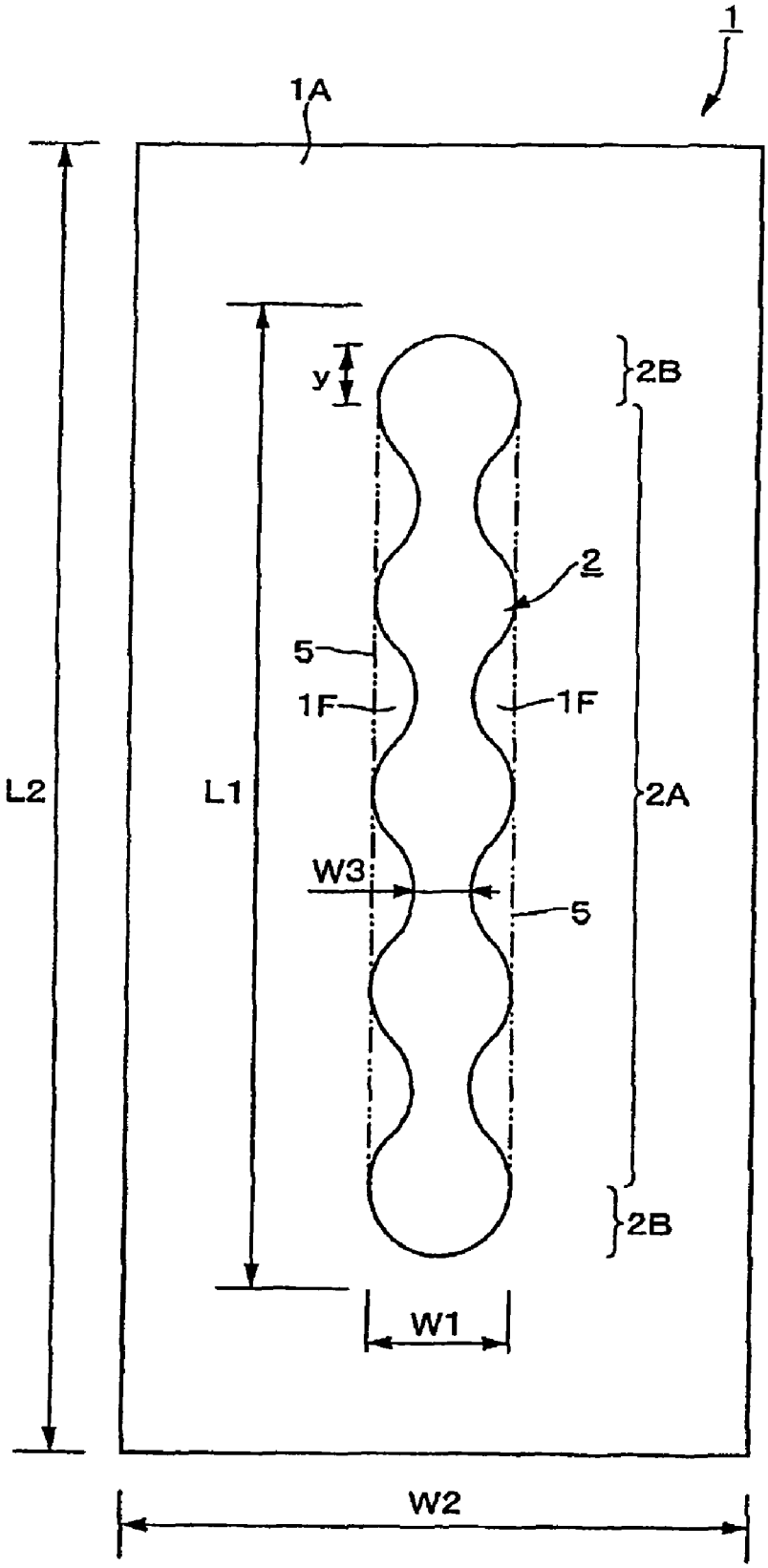
FIG. 7 is a plan view of the household sanitary tissue paper container.

Additionally, as shown in FIG. 7, the taking-out opening 2 can form a cloud shape composed of a wavy edge symmetric with respect to a central line in its width direction, or the like.

The taking-out opening of the present invention may have a portion wider than the finger inserting portion or a portion narrower than the supporting portion, as long as it has the finger inserting portion and the supporting portion.

The household sanitary tissue paper container of the present invention is preferably formed out of paper having a certain degree of rigidity such as paperboard, but it can be formed out of resin having the same degree of rigidity.

EXPLANATION OF REFERENCE NUMERALS

1 . . . household sanitary tissue paper container, 2 . . . taking-out opening, 2A . . . supporting portion, 2B . . . finger inserting portion, 3 . . . perforated line, 4 . . . unsealing strip, 5 . . . crush portion.

The invention claimed is:

1. A household sanitary tissue paper container that is made of paperboard and does not have any film for supporting a household sanitary tissue paper at a taking-out opening, wherein a taking-out opening is an opening formed by removing a continuous unsealing strip along a longitudinal direction in an area formed by a continuous perforated line for tearing at an upper face of the container, said opening having a shape same as said area formed by the continuous perforated line at the upper face of the container, the taking-out opening includes finger inserting portions formed at both end portions in a longitudinal direction of the taking-out opening, the finger inserting portions being arc-shaped and curved outwardly in a longitudinal direction of the container, and a pair of supporting portions provided continuous to the finger inserting portions, the pair of supporting portions being formed by removing the unsealing strip so as to face either side of a pulled-out household sanitary tissue paper and support the pulled-out household sanitary tissue paper, edges of the supporting portions have a shape extending out alike and gently curved toward a center from both ends in the longitudinal direction of the supporting portion and are spaced from each other for an entire length when said unsealing strip is removed, at outward positions in a width direction of the supporting portions, pressed lines for raising are formed along the longitudinal direction so as to be continuous to the taking-out opening so that each of the supporting portions can stand upwardly, and at least a portion of the perforated line for tearing corresponding to the edge of the supporting portion is a double perforated line.

2. The household sanitary tissue paper container made of paperboard according to claim 1, wherein the perforated line for tearing is a double perforated line comprising an inner perforated line and an outer perforated line comprising a cut portion and a tie portion, a section line formed when the perforated line for tearing has been torn is configured so as to alternate between the cut portions of the inner perforated line and the outer perforated line, a distance between the outer perforated line and the inner perforated line is 1 mm or less, a length ratio of the cut portion to the tie portion in the inner perforated line is 1.0 to 10.0, and a length ratio of the cut portion to the tie portion in the outer perforated line is 1.0 to 0.1.

3. The household sanitary tissue paper container made of paperboard according to claim 1, wherein the finger inserting portion is formed to have a portion which is 15 mm or more in length and 20 mm or more in width.

4. The household sanitary tissue paper container made of paperboard according to claim 1, wherein a length ratio of the taking-out opening to the long side of the container is 65 to 8%.

5. The household sanitary tissue paper container made of paperboard according to claim 4, wherein the maximum width ratio of the taking-out opening to the short side of the container is 16 to 50%, and the maximum width of the taking-out opening is 38 mm or more.

6. The household sanitary tissue paper container made of paperboard according to claim 1, wherein the maximum width ratio of the taking-out opening to the short side of the container is 16 to 50%, and the maximum width of the taking-out opening is 38 mm or more.

7. The household sanitary tissue paper container made of paperboard according to claim 1, wherein the narrowest width. ratio of the space between the edges of the supporting portions to the maximum width of the taking-out opening is 16 to 40%, and the narrowest width of the space between the edges of the supporting portions is 6.08 mm or more.

8. The household sanitary tissue paper container made of paperboard according to claim 1, wherein the taking-out opening is formed so as to gradually increase in width with a gently curved line from a center thereof in the longitudinal direction towards both end portions thereof to reach a maximum width near the both end portions and to gradually decrease in width with a sharp curved line to further approach the both ends.

9. The household sanitary tissue paper container made of paperboard according to claim 1, wherein the taking-out opening is formed so as to gradually increase in width with a gently curved line from a center thereof in the longitudinal direction towards both end portions thereof to reach a maximum width near the both end portions and to gradually decrease in width with a sharp curved line to further approach the both ends.

10. The household sanitary tissue paper container made of paperboard according to claim 1, wherein the supporting portions for the household sanitary tissue paper are formed at a center in the longitudinal direction of the container, and the finger inserting portions are formed at both end portions of the supporting portions in the longitudinal direction.

11. A household sanitary tissue paper container that is made of paperboard and does not have any film for supporting a household sanitary tissue paper at a taking-out opening, wherein a taking-out opening is an opening formed by removing a continuous unsealing strip along a longitudinal direction in an area formed by a continuous perforated line for tearing at an upper face of the container, said opening having a shape same as said area formed by the continuous perforated line at the upper face of the container, the taking-out opening includes finger inserting portions formed at both end portions in a longitudinal direction of the taking-out opening, the finger inserting portions being arc-shaped and curved outwardly in a longitudinal direction of the container, and a pair of supporting portions provided continuous to the finger inserting portions, the pair of supporting portions being formed by removing the unsealing strip so as to face either side of a pulled-out household sanitary tissue paper and support the pulled-out household sanitary tissue paper, edges of the supporting portions form wavy lines having undulation in a width direction of the supporting portion, and edges of the supporting portions are spaced from each other for an entire length of the supporting portions and cove and projected portions in the wavy lines face each other, and at outward positions in a width direction of the supporting portions, pressed lines are formed along a longitudinal direction of the supporting portions at cove portions of the wavy line and between a cove portion of the wavy line and the finger inserting portion, so that the respective supporting portions can stand upwardly using the pressed lines for raising.

12. The household sanitary tissue paper container made of paperboard according to claim 11, wherein the supporting portions for the household sanitary tissue paper are formed at a center in the longitudinal direction of the container, and the finger inserting portions are formed at both end portions of the supporting portions in the longitudinal direction, the finger inserting portions being arc-shaped curved outwardly in the longitudinal direction of the container.

13. The household sanitary tissue paper container made of paperboard according to claim 11, wherein a length ratio of the taking-out opening to the long side of the container is 65 to 87%.

* * * * *